US008728254B2

(12) United States Patent
Singh et al.

(10) Patent No.: US 8,728,254 B2
(45) Date of Patent: May 20, 2014

(54) MG ALLOY

(75) Inventors: Alok Singh, Ibaraki (JP); Hidetoshi Somekawa, Ibaraki (JP); Toshiji Mukai, Ibaraki (JP); Yoshiaki Osawa, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 311 days.

(21) Appl. No.: 13/258,812

(22) PCT Filed: Mar. 23, 2010

(86) PCT No.: PCT/JP2010/054999

§ 371 (c)(1),
(2), (4) Date: Nov. 28, 2011

(87) PCT Pub. No.: WO2010/110272

PCT Pub. Date: Sep. 30, 2010

(65) Prior Publication Data

US 2012/0067463 A1 Mar. 22, 2012

(30) Foreign Application Priority Data

Mar. 24, 2009 (JP) ..... 2009-071754

(51) Int. Cl.
*C22C 23/04* (2006.01)

(52) U.S. Cl.
CPC ..... *C22C 23/04* (2013.01)
USPC ..... 148/403; 148/406; 420/405; 420/411

(58) Field of Classification Search
None
See application file for complete search history.

(56) References Cited

U.S. PATENT DOCUMENTS

| | | | | |
|---|---|---|---|---|
| 6,471,797 | B1 | 10/2002 | Kim et al. | |
| 8,313,692 | B2 * | 11/2012 | Somekawa et al. | 420/408 |
| 2007/0204936 | A1 * | 9/2007 | Kato et al. | 148/420 |
| 2009/0056837 | A1 | 3/2009 | Nakata et al. | |
| 2009/0320967 | A1 * | 12/2009 | Tsai et al. | 148/538 |

FOREIGN PATENT DOCUMENTS

| | | |
|---|---|---|
| JP | 2002-309332 | 10/2002 |
| JP | 2005-113234 | 4/2005 |
| JP | 2005-113235 | 4/2005 |
| JP | 2007-284782 | 11/2007 |
| JP | 2009-084685 | 4/2009 |
| WO | 2008/016150 | 2/2008 |

OTHER PUBLICATIONS

International Search Report issued Jun. 29, 2010 in International (PCT) Application No. PCT/JP2010/054999 of which the present application is the national stage.

H. Somekawa et al., "High Strength and fracture toughness of magnesium alloys by dispersion of icosahedral phase particles", vol. 78, No. 4, pp. 359-362, Apr. 1, 2008.

T. Mukai et al., "Duralumin ni Hitteki sum Kokyodo Kojinsei Magnesium Gokin Sosei no Kokoromi", vol. 56, No. 7, pp. 50-83, Jul. 1, 2008.

* cited by examiner

*Primary Examiner* — George Wyszomierski
(74) *Attorney, Agent, or Firm* — Wenderoth, Lind & Ponack, L.L.P.

(57) ABSTRACT

Provided is a Mg alloy, in which precipitated particles are dispersed and which has enhanced tensile strength regardless of the size of the magnesium matrix grains therein.

1 Claim, 9 Drawing Sheets

MG ALLOY

This is the National Stage of International Application No. PCT/JP2010/054999, filed Mar. 23, 2010.

TECHNICAL FIELD

The present invention relates to a Mg alloy having a quasicrystal phase.

BACKGROUND ART

Magnesium is lightweight and is rich as a resource, and is therefore much highlighted as a weight-reducing material for electronic appliances, structural parts, etc. Above all, in case where applications to mobile structural parts such as rail cars, automobiles and others are investigated, the materials are required to have high strength and high ductility characteristics from the viewpoint of the safety and reliability in use thereof. For improving the characteristics of metallic materials, reduction in the scale (size) of the microstructure of matrix, or that is, so-called grain refining is well known. A fine particles dispersion strengthening method (of dispersing fine particles in a matrix) is also one method for improving the characteristics of metallic materials.

Recently, it has become specifically noted to use, as dispersion particles, a quasicrystal phase which does not have a configuration of recurring units of predetermined atomic arrangement, or that is, does not have translational regularity unlike ordinary crystal phase. The principal reason is because the quasicrystal particles well match with the crystal lattice of matrix and the lattices may strongly bond to each other, and therefore, the dispersion particles of the type could hardly be a nucleus or a starting point for destruction during plastic deformation. Regarding magnesium alloys, it is known that dispersion of quasicrystal particles therein brings about excellent mechanical characteristics, as shown in the following Patent References 1 to 5.

With that, for further performance advances, refining the magnesium matrix is tried.

Patent Reference 1: JP-A 2002-309332
Patent Reference 2: JP-A 2005-113234
Patent Reference 3: JP-A 2005-113235
Patent Reference 4: WO2008-16150
Patent Reference 5: JP-A 2009-084685

DISCLOSURE OF THE INVENTION

Problems to be Solved

For refining crystal particles, used is a method of severe plastic deformation; however, in the method of severe plastic deformation, it is considered that the life of containers and molds may be short and the energy loss may be large as compared with those in a method of ordinary hot plastic deformation.

In consideration of the situation as above, an object of the present invention is to provide a Mg alloy having an increased tensile strength regardless of the size of the magnesium matrix grains.

Means for Solving the Problems

For solving the above-mentioned problems, the first invention is a Mg alloy formed of a Mg matrix having a quasicrystal phase, in which are dispersed precipitated particles.

The second invention is characterized in that, in addition to the characteristic of the first invention, the precipitated particles have an acicular rod-like morphology and comprise Mg—Zn.

The third invention is characterized in that, in addition to the characteristic of the second invention, the precipitated particles are dispersed in the magnesium matrix.

The fourth invention is characterized in that, in addition to the characteristic of the third invention, the size of the magnesium matrix grains is from 10 to 50 μm.

The fifth invention is characterized in that, in addition to the characteristic of the second invention, the precipitated particles have an aspect ratio of from 5 to 500, a length of from 10 to 1500 nm and a thickness of from 2 to 50 nm.

The sixth invention is characterized in that, in addition to the characteristic of the first invention, the Mg alloy is represented by a general formula (100-x-y) at % Mg-y at % Zn-x at % RE, in which RE means any one rare earth element of Y, Gd, Tb, Dy, Ho or Er, x and y each mean at %, $0.2 \le x \le 1.5$ and $5x \le y \le 7x$.

Advantage of the Invention

According to the invention, the Mg alloy has much better mechanical characteristics than those of the conventional Mg alloys in which precipitated particles are not dispersed.

MODE FOR CARRYING OUT THE INVENTION

Figure 1:
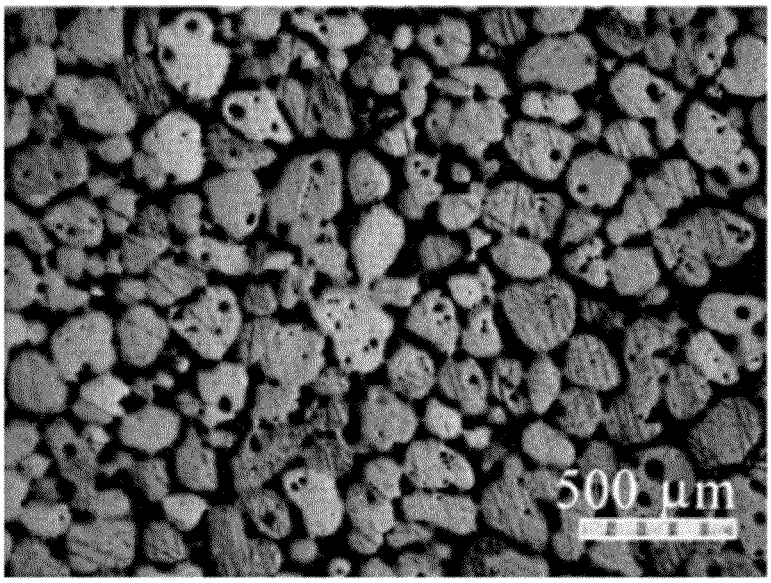
FIG. 1 is a photograph of the microstructure of the heat-treated material in Example 1, taken with an optical microscope.

For forming a quasicrystal phase in an Mg alloy, the following composition range is favorable. In an Mg alloy represented by a general formula (100-x-y) at % Mg-y at % Zn-x at % RE (where RE means any one rare earth element of Y, Gd, Tb, Dy, Ho or Er, x and y each mean at %), the composition range capable of expressing a quasicrystal phase of Mg—Zn—RE satisfies $0.2 \le x \le 1.5$ and $5x \le y \le 7x$.

In the Mg alloy falling within the above-mentioned composition range, the rare earth element, present in the particles such as the quasicrystal particles, is dissolved in the magnesium matrix prior to hot plastic deformation such as extrusion, rolling or the like of the alloy, thereby reducing the dendrite structure that is a cast structure therein, and reducing the proportion of the particles such as quasicrystal particles, intermetallic compound particles and the like that disperse in the magnesium matrix. For obtaining the structure of the type, the heat treatment temperature may be from 460° C. to 520° C., preferably from 480° C. to 500° C., and the retention time may be from 12 hours to 72 hours, preferably from 24 hours to 48 hours.

After the above-mentioned solutionized structure has been formed, the alloy is worked for hot plastic deformation such as extrusion, rolling or the like, thereby reforming a structure of quasicrystal phase particles dispersed in the magnesium matrix having a size of from 10 to 50 μm, preferably from 20 to 40 μm, or in the grain boundary. For forming the structure of the type, the temperature for plastic deformation may be from 420° C. to 460° C., preferably from 430° C. to 450° C. The applied strain by the plastic deformation is preferably at least 1. The deformation may be given to the starting material before shaped, or may be given thereto while shaped to have a predetermined form.

Then, aging treatment is applied thereto. In the aging treatment, the treatment temperature may be from 100° C. to 200° C., preferably from 100° C. to 150° C., and the retention time may be from 24 to 168 hours, preferably from 24 hours to 72 hours. The aging treatment forms a structure of fine precipitated particles uniformly dispersed in the magnesium matrix in the Mg alloy. The precipitated particles comprise Mg—Zn and have an acicular rod-like morphology having an aspect ratio of at least 3, their thickness (the minor diameter of the precipitated particles) is from 2 to 50 nm, and they are dispersed in the magnesium matrix as so aligned that their longitudinal direction are in a predetermined direction.

It is considered that the reason why the acicular particles are aligned with their longitudinal direction kept in a predetermined direction would be because the alloy after processed through extrusion is processed for aging treatment. In case where the alloy is kept as such after given plastic deformation such as casting, rolling, extrusion or the like, it is considered that the precipitated particles therein may be isometric ones or may be acicular ones having a small aspect ratio of at most 3, and may be dispersed in random directions.

In case where the above-mentioned aging treatment is attained as a final heat treatment after the Mg alloy has been shaped to have a predetermined form, there is produced a Mg alloy having the formed precipitated particle phase therein.

The aspect ratio of the precipitated particles may be from 5 to 500, preferably from 5 to 100, more preferably from 5 to 10. The length of the precipitated particles (the length of the long axis of the precipitated particles) may be from 10 to 1500 nm, preferably from 10 to 500 nm, more preferably from 10 to 1000 nm. The aspect ratio and the size may be controlled by controlling the concentration of the added zinc and rare earth element, the heat treatment temperature before the treatment for hot plastic deformation, the temperature during the hot treatment, the temperature and the retention time in the aging treatment, etc.

The Mg alloy member having the thus-formed structure exhibits a good trade-off-balance of strength/ductility even with a relatively coarse magnesium matrix.

Example 1

A master alloy was prepared by melt-casting commercial-grade pure magnesium (purity 99.95%) with 6 atm % zinc and 1 atom % yttrium added thereto. Subsequently, this was heat-treated in a furnace at 480° C. for 24 hours to give a heat-treated (solutionized) material.

The heat-treated material was machined to give extrusion billets each having a diameter of 40 mm. The extrusion billet was put into an extrusion container heated at 430° C., then kept therein for about 30 minutes, and thereafter hot-extruded at an extrusion ratio of 25/1, thereby giving an extruded material having a diameter of 8 mm. Thus obtained, the extruded material was aged in an oil bath at 150° C. for 24 hours to give an aging-treated material.

Figure 2:
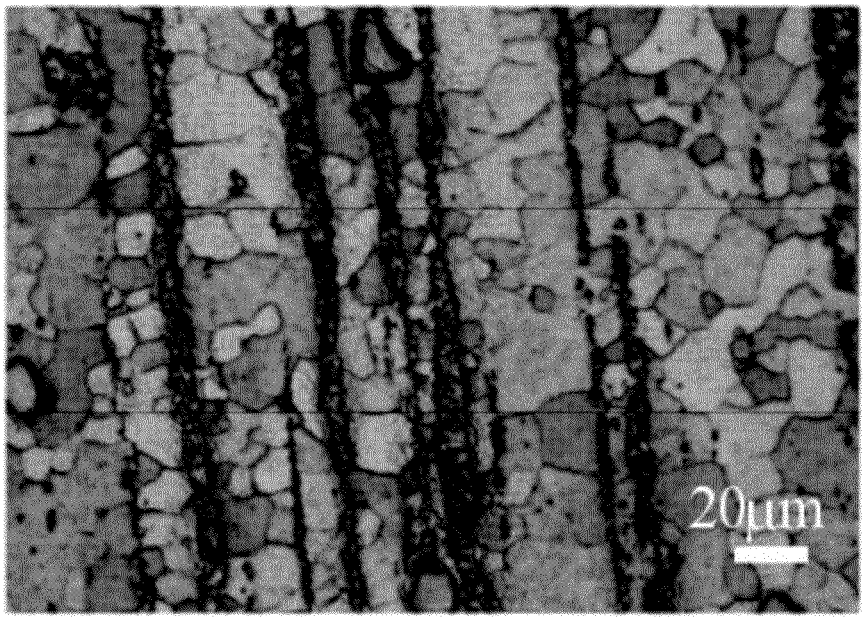
FIG. 2 is a photograph of the microstructure of the extruded material in Example 1, taken with an optical microscope.

The microstructures of the heat-treated material and the extruded material were observed with an optical microscope, and their microstructure photographs are shown in FIG. 1 and FIG. 2, respectively.

It is known that, in the heat-treated material (FIG. 1), the occupancy of the dendrite structure that is a typical cast structure is small, and in the extruded material (FIG. 2), isometric crystal grains are formed.

The grain size of the two samples, as measured according to a section method, is about 350 μm (heat-treated material) and 25.5 μm (extruded material). The microstructure observation results of the extruded material and the aging-treated material taken with a transmission electron microscope or according to a high-angle annular dark field method are shown in FIG. 3 to FIG. 5.

Figure 3:
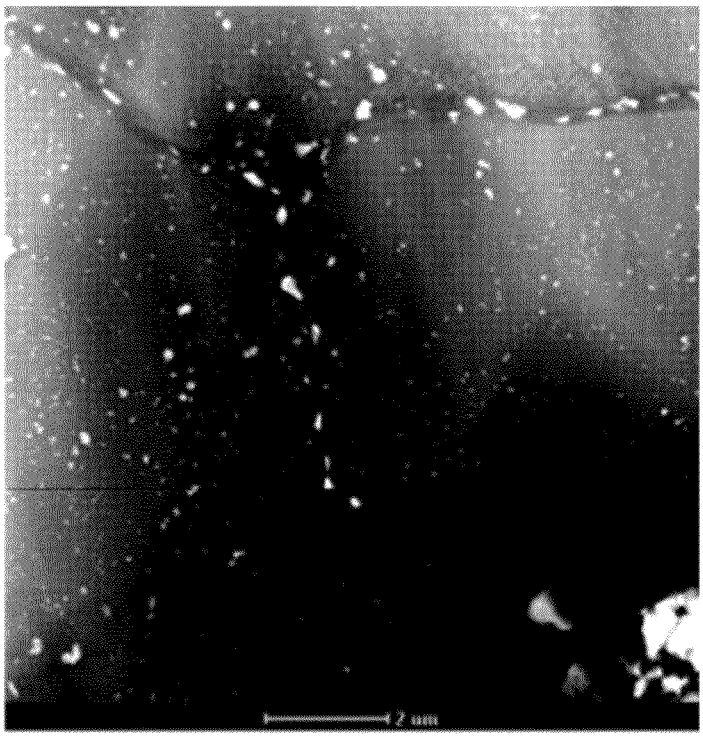
FIG. 3 is a photograph of the microstructure of the extruded material in Example 1, taken according to a high-angle annular dark field method.

The white contrast appearing in FIG. 3 is a quasicrystal phase of Mg—Zn—Y (i-phase: $Mg_3Zn_6Y_1$), and it is confirmed that fine quasicrystal particles exist in the grain boundary and inside the grains. On the other hand, the white contrast appearing in FIG. 4 is a precipitated phase ($\beta_1$'-phase) of Mg—Zn, and it is confirmed that the phase has an acicular (rod-like) morphology. From FIG. 5, it is known that the precipitated particles are densely dispersed inside the magnesium matrix.

Figure 4:
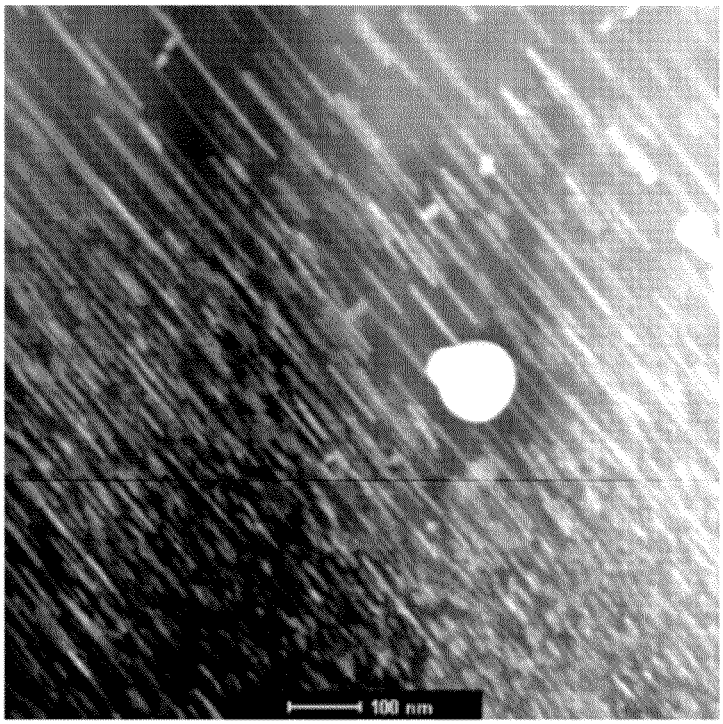
FIG. 4 is a photograph of the microstructure of the aging-treated material in Example 1, taken according to a high-angle annular dark field method.
Figure 5:
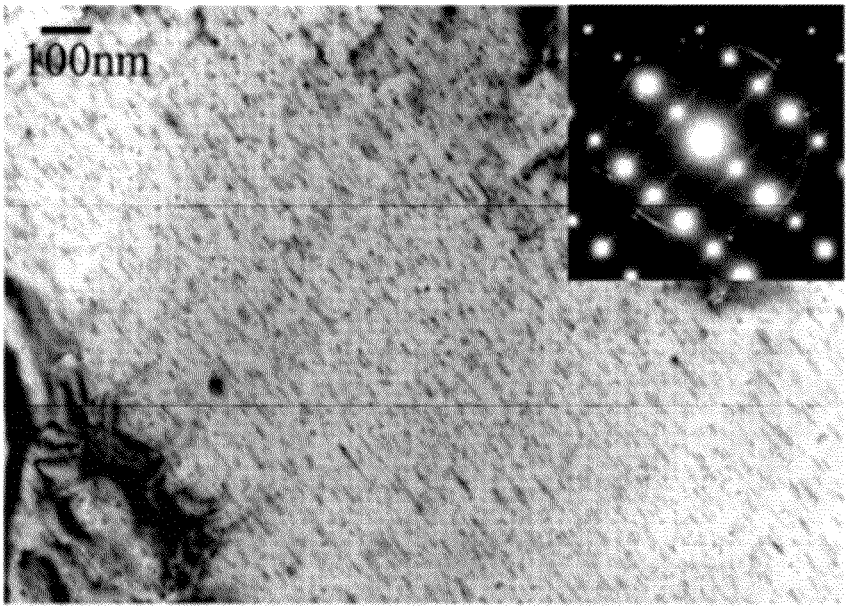
FIG. 5 is a photograph of the microstructure of the aging-treated material in Example 1, taken with a transmission electron microscope.

From FIG. 4 and FIG. 5, the precipitated particles have a mean aspect ratio of 5, the length (length of the long axis) of the precipitated particles is from 12 to 30 nm and the thickness (short axis) thereof is from 3 to 15 nm.

Next, from the extruded material and the aging-treated material, sampled were tension test pieces having a diameter of the parallel part thereof of 3 mm and a length of 15 mm, and compression test pieces having a diameter of 4 mm and a height of 8 mm; and the test pieces were tested for tension/compression characteristics at room temperature.

The direction in which the test pieces were sampled was a parallel direction to the extrusion direction, and the initial pulling/compression strain rate was $1\times10^{-3}$ $s^{-1}$.

Figure 6:
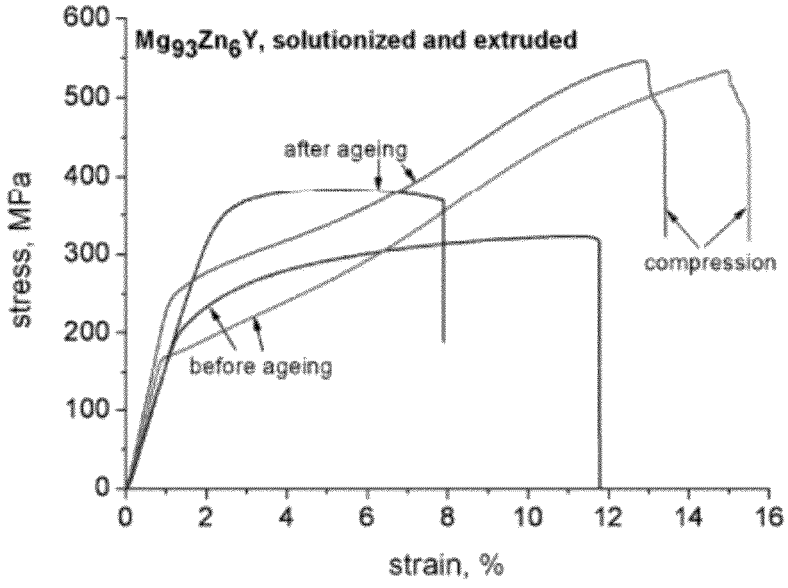
FIG. 6 is a nominal stress-nominal strain curve obtained in the room temperature tension/compression test in Example 1.

FIG. 6 shows a nominal stress-nominal strain curve obtained in the room temperature tension/compression test. Regarding the yield stress in tension and the yield stress in compression of the two samples, the extruded material had 213 MPa and 171 MPa, and the aging-treated material had 352 MPa and 254 MPa, respectively. It is known that, owing to the fine dispersion of the precipitated particles ($\beta_1$'-phase) through aging treatment, the tension characteristic and the compression characteristic improved by 65% and by 48%, respectively. To the yield stress in tension/compression, applied was an offset value of 0.2% strain.

Example 2

An extruded material and an aging-treated material were produced according to the same process and under the same condition as in Example 1, except that the extrusion temperature was 380° C.

Figure 7:
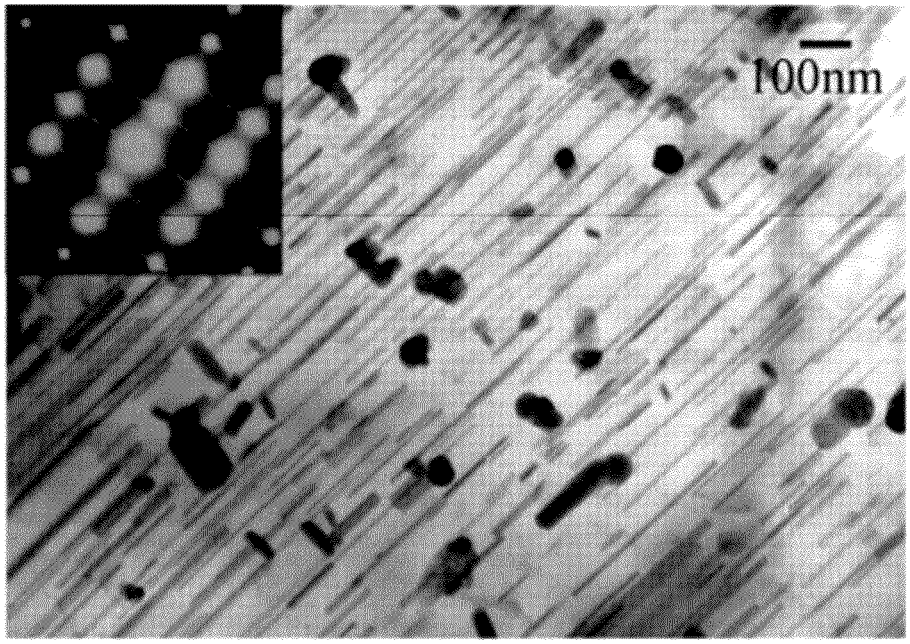
FIG. 7 is a photograph of the microstructure of the aging-treated material in Example 2, taken with a transmission electron microscope.

FIG. 7 shows a photograph of the microstructure of the aging-treated material, taken with a transmission electron microscope. Like in FIG. 4 and FIG. 5, dispersion of precipitated particles ($\beta_1$'-phase) comprising Mg—Zn and having an acicular morphology in the magnesium matrix is confirmed.

The mean aspect ratio of the precipitated particles was 50, the length (the length of the long axis) of the precipitated particles was from 150 to 1100 nm, and the thickness (the minor diameter) thereof was from 3 to 25 nm.

On the other hand, when compared with the morphology of the precipitated particles shown in FIG. 4 and FIG. 5, the morphology of the precipitated particles herein is such that the particles are relatively coarse in size and are relatively nondense.

Having the same figuration and under the same condition as in Example 1, the extruded material was evaluated in point of the room temperature mechanical characteristics thereof. The obtained results are shown in Table 1. It is confirmed that aging treatment after extrusion improves the tension/compression characteristics.

Example 3

Figure 8:
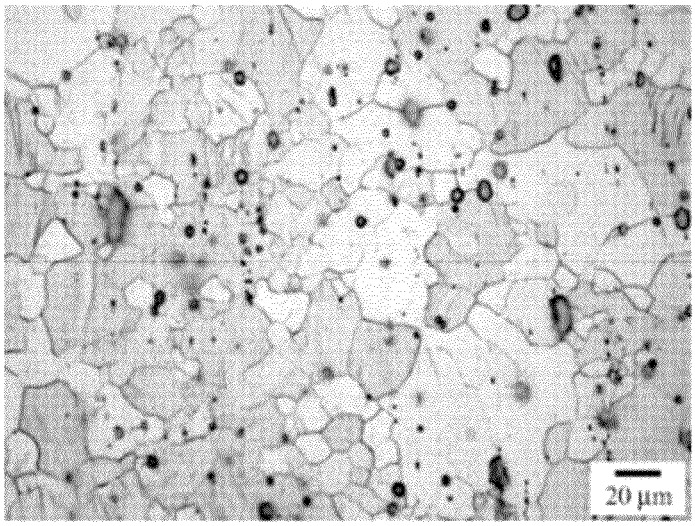
FIG. 8 is a photograph of the microstructure of the extruded material in Example 3, taken with an optical microscope.
Figure 9:
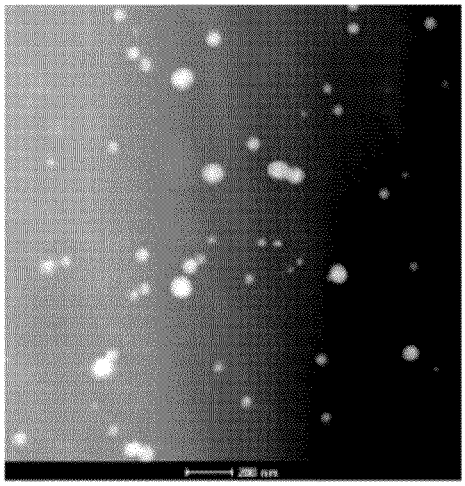
FIG. 9 is a photograph of the microstructure of the extruded material in Example 3, taken according to a high-angle annular dark field method.

A master alloy was prepared by melt-casting commercial-grade pure magnesium (purity 99.95%) with 3 atm % zinc and 0.5 atm % yttrium added thereto. Subsequently, this was heat-treated in a furnace at 480° C. for 24 hours. After thus heat-treated, this was processed in the same manner as in Examples 1 and 2 to produce an extruded material and an aging-treated material, except that the extrusion temperature was 420° C. FIG. 8 and FIG. 9 each show a photograph of the microstructure of the extruded material, taken with an optical microscope or taken according to a high-angle annular dark field method, respectively.

From FIG. 8, it is known that the Mg matrix is isometric and the mean grain size is 36.2 μm. The white contrast appearing in FIG. 9 indicates quasicrystal particles, and they exhibit a uniform and fine dispersion phase; however, the presence of precipitated particles of Mg—Zn is not confirmed anywhere. The reason is because the material was not processed for aging treatment.

Having the same figuration and under the same condition as in Examples 1 and 2, the extruded material was evaluated in point of the room temperature mechanical characteristics thereof, and the obtained results are shown in Table 1. It is confirmed that, like in Examples 1 and 2, aging treatment after extrusion improves the tension/compression characteristics of the Mg alloy member.

TABLE 1

| | Extrusion Temperature (° C.) | Aging-Treatment Temperature (° C.) | Yield Stress in Tension (MPa) | Yield Stress in Compression (MPa) |
|---|---|---|---|---|
| Example 1: | 430 | not treated | 213 | 171 |
| Mg—6Zn—1Y | 430 | 150 | 352 | 254 |
| Example 2: | 380 | not treated | 251 | 210 |
| Mg—6Zn—1Y | 380 | 150 | 265 | 233 |
| Example 3: | 420 | not treated | 207 | 139 |
| Mg—3Zn—0.5Y | 420 | 150 | 275 | 180 |

INDUSTRIAL APPLICABILITY

The Mg alloy of the invention is lightweight and has, in addition, an increased tensile strength, and is therefore effective for electronic instruments and structural parts, and also for mobile structural parts such as rail cars, automobiles, etc.

The invention claimed is:

1. A Mg alloy comprising a magnesium matrix, wherein the Mg alloy is represented by a general formula (100-x-y) at % Mg-y at % Zn-x at % RE, wherein RE is a rare earth element selected from the group consisting of Y, Gd, Tb, Dy, Ho and Er, wherein x and y each mean at %, and wherein $0.2 \leq x \leq 1.5$ and $5x \leq y \leq 7x$, wherein the Mg alloy has a quasicrystal phase, wherein acicular rod-like precipitated particles comprising Mg—Zn are dispersed in the magnesium matrix and are aligned in a longitudinal direction of the acicular rod-like precipitated particles by an aging treatment after a plastic deformation of the Mg alloy, wherein the magnesium matrix comprises grains that have a size of from 10 to 50 μm, and wherein the acicular rod-like precipitated particles have an aspect ratio of from 5 to 500, a length of from 10 to 1500 nm and a thickness of from 2 to 50 nm.

* * * * *